US006334396B2

(12) United States Patent
Perry et al.

(10) Patent No.: US 6,334,396 B2
(45) Date of Patent: Jan. 1, 2002

(54) SWITCH STONEBLOWER

(75) Inventors: William E. Perry; Kevin A. Hansen, both of Ludington, MI (US)

(73) Assignee: Pandrol Jackson, Inc., Ludington, MI (US)

( * ) Notice: Subject to any disclaimer, the term of this patent is extended or adjusted under 35 U.S.C. 154(b) by 0 days.

(21) Appl. No.: 09/366,040

(22) Filed: Aug. 2, 1999

(51) Int. Cl.[7] ..... E01B 1/00
(52) U.S. Cl. ..... 104/2; 104/12
(58) Field of Search ..... 104/2, 7.1, 10, 104/11, 12

(56) References Cited

U.S. PATENT DOCUMENTS 4,134,342 1/1979 Sakai et al.
4,386,570 6/1983 Waters
4,449,459 5/1984 Martin-Sain
4,497,256 * 2/1985 Hansmann et al. 104/11
4,528,912 7/1985 Hansmann et al.
4,850,752 7/1989 Sorey-Yard
5,007,350 * 4/1991 Theurer 104/12
5,101,733 4/1992 Mohr
5,577,446 * 11/1996 Perry et al. 104/2

FOREIGN PATENT DOCUMENTS 727524 8/1955
2021180 11/1979
2115463 9/1983
WO9303225 2/1993

* cited by examiner

*Primary Examiner*—S. Joseph Morano
*Assistant Examiner*—Robert J. McCarry, Jr.
(74) *Attorney, Agent, or Firm*—Warner Norcross & Judd

(57) ABSTRACT

A track maintenance vehicle having a workhead that is pivotally mounted to the superstructure at its upper end. The workhead includes a blowing tube mounted at its lower end and a vertical cylinder that is selectively extendable and retractable to control the height of the blowing tube. The vehicle includes a control system that controls the height of the blowing tube as well as the left/right and fore/aft positions of the workhead. The track maintenance vehicle further includes an automated height control system that automatically extends and retracts the vertical cylinder to position the blowing tube at a uniform height despite its lateral disposition.

44 Claims, 10 Drawing Sheets

SWITCH STONEBLOWER

BACKGROUND OF THE INVENTION

The present invention relates to railroad track maintenance equipment and more particularly to a vehicle for performing maintenance on the bed of a railroad track.

It is important for railroad track to remain substantially level and uniform along its length. Although slight and gradual variations in the profile of the track are typically acceptable, rapid or severe longitudinal or lateral variations can have a significant impact on the performance of the track. As a result, significant efforts are made to maintain the railroad track with a level profile. To this end, railroad track is typically laid on a bed of ballast stones, which provide a firm foundation for the ties or sleepers. Once the track is leveled, the ballast stone bed helps to preserve the level of the track for a relatively long period of time. Nonetheless, over extended use the stones shift, crumble or otherwise degrade causing undesired variations in the track, such as bows, twists and undulations. For example, stone under one end of a particular tie may shift or crumble under repeated train passes causing that end of the tie to settle. As the tie settles, it creates a low spot in the rail, making travel over the rail rough and, depending on the severity, possibly increasing the likelihood of a derailment.

To maintain the level of a railroad track, it is necessary to perform periodic maintenance on the railroad track bed. One particularly effective method for maintaining a railroad track bed is to supply new ballast stones to the bed beneath settled ties. Typically, the new ballast stones are blown under the tie using compressed air. As a result, this method is commonly referred to as "stoneblowing." Stoneblowers have been in use for years and provide significant advantages over other maintenance techniques. For example, experience has revealed that track that is maintained by stoneblowing may retain a level profile significantly longer than track maintained using conventional "tamping" methods.

Stoneblowing is typically performed by a track maintenance vehicle, called a stoneblower. A stoneblower typically includes a jack for lifting the railroad track and associated ties and at least one workhead for delivering new stone under the lifted ties. A stoneblower workhead typically includes a pair of blowing tubes that can be thrust into the ballast adjacent to the tie to deliver new stone. The blowing tubes are positioned on the workhead to straddle the rail and supply stone on opposites sides of the rail. In use, the blowing tubes are typically aligned with the edge of the tie and include openings toward their lower ends to allow ballast to blown directly beneath the tie. A conventional workhead is mounted toward the bottom of the vehicle on a pair of movable carriages. The carriages permit a limited range of lateral and longitudinal movement of the workhead. Conventional stoneblowers are not well-suited for use in maintaining switches and other complex track configurations. The double carriage arrangement of a conventional workhead often fails to provide enough adjustment to accommodate the complex tie and rail arrangements found in switches and the like. Also, the dual blowing tube workhead is not well-suited for treating many locations in a switch as one blowing tube may impede insertion of the other into narrow locations.

SUMMARY OF THE INVENTION

The aforementioned problems are overcome by the present invention wherein a stoneblower is provided with a vertically extended workhead that pivots from a point located near the top of the stoneblower. The position of the workhead is controlled by a pair of hydraulic cylinders operatively connected to a central portion of the workhead. In a preferred embodiment, the workhead includes a single blowing tube extending downwardly from the bottom of the workhead.

In a more preferred embodiment, the stoneblower includes a computerized control system for controlling the position of the workheads. The control system includes an automated height control system that automatically positions the blowing tube at the desired height regardless of the left/right (or lateral) position of the workhead. The uniform height control system automatically adjusts the position of the vertical cylinder to compensate for changes in the height of the blowing tube that would otherwise result from arcuate movement of the workhead.

In an even more preferred embodiment, the workhead includes two pair of workheads, a first pair located over the left rail and a second pair located over the right rail. Each pair of workheads includes a forward workhead having a rearwardly opening blowing tube and a rear workhead having a forwardly opening blowing tube. The forward and rear workheads are adapted to align with the forward and rearward faces of a tie, respectively.

The present invention provides an effective stoneblower that is particularly well suited for maintaining switches and other complex track configurations. The workheads are easily adjustable to treat even narrow locations in the rail. Because the workhead pivots near the top of the vehicle, increased fore/aft and left/right movement is possible with only a relatively small amount of vertical movement. The pivotal mounting permits a broad range of movement of the workhead without requiring a correspondingly broad range of movement in the actuating assembly. In fact, the workhead can even treat locations outside of the lateral profile of the vehicle. Further, the automated height control system permits left and right adjustment of the workhead without requiring manual adjustment of the height of the workhead.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 1A:
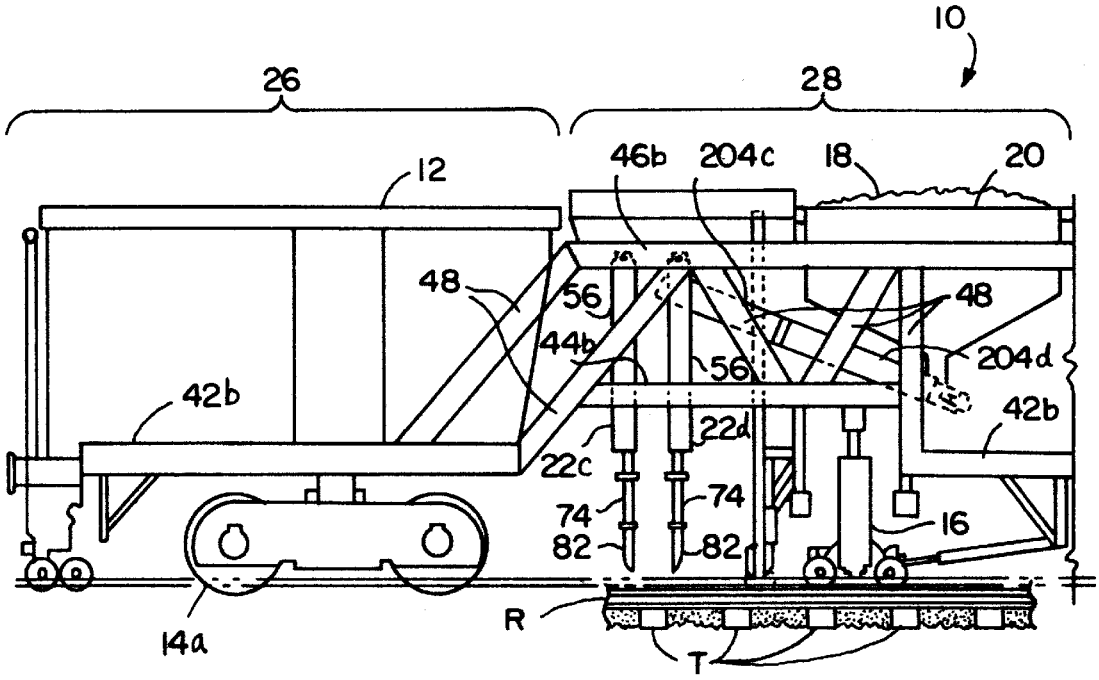
FIG. 1*a* is a side elevational view of a first portion of a stoneblower in accordance with a preferred embodiment of the present invention.
Figure 1B:
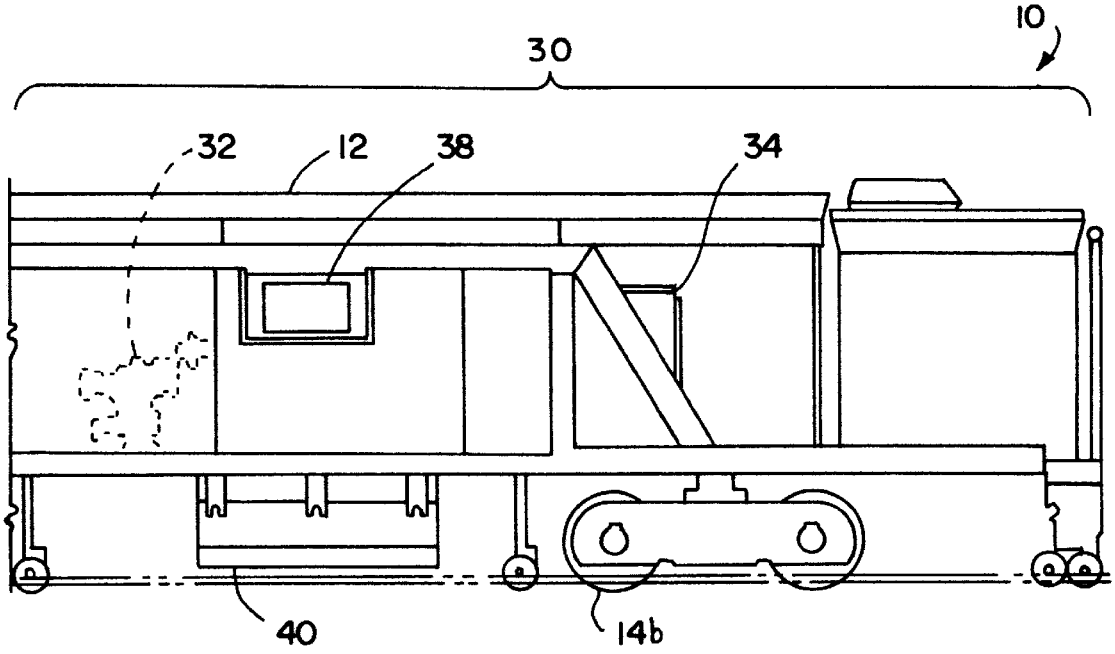
FIG. 1*b* is a side elevational view of a second portion of the stoneblower.

A stoneblower incorporating the present invention is shown in FIG. 1 and generally designated 10. The stoneblower generally includes a superstructure 12, trucks 14*a–b* for rollingly supporting the superstructure on a railroad track, a jackbeam 16 for lifting the track and attached ties, a supply of ballast stones 18 carried in a stone hopper 20, and a plurality of workheads 22 for delivering the ballast stones 18 under the lifted tie. Generally, stoneblowers and their operation are known to those skilled in the art. Therefore, only a brief description of the stoneblower's operation is provided. The stoneblower 10 of the present invention is specially adapted to perform maintenance on switches and other complex rail arrangements. In operation, the stoneblower 10 travels along the track to a location that requires maintenance. These locations are by typically determined using any of a variety of well-known rail profiling techniques. The measured track profile is used to calculate which ties require additional ballast and how much ballast should be supplied. A suitable track profile measuring system carried by the stoneblower is disclosed in U.S. Pat. No. 5,605,099 entitled MAINTENANCE VEHICLE AND METHOD FOR MEASURING AND MAINTAINING THE LEVEL OF A RAILROAD TRACK and U.S. Pat. No. 5,167,639 entitled RAILROAD MAINTENANCE VEHICLE REFERENCE SYSTEM TRANSDUCER, which are incorporated herein by reference. Once the stoneblower 10 reaches a tie where additional stone is required, the jackbeam 16 is used to lift the rail and attached ties. The workheads 22 then force blowing tubes into the ballast adjacent the raised track ties. Stone is blown into the void beneath the raised ties in the appropriate quantity to level the ties. The workhead withdraws the blowing tubes, the track is lowered, and the stoneblower moves down the track to the next location. If desired, the workheads 22 can be repositioned to supply ballast stone to additional locations along the tie before the track is lowered and the stoneblower moves down the track.

As noted above, the stoneblower 10 includes a superstructure 12 mounted upon front and rear trucks 14*a–b*. The trucks 14*a–b* are generally conventional and will not be described in detail. Suffice it to say that the trucks 14*a–b* are adapted to travel along the railroad track and include at least one pair of drive wheels that are operatively connected to the main engine 32 to provide the stoneblower 10 with motion. The superstructure 12 is carried by the trucks 14*a–b* and includes an operator compartment 26, a workhead section 28, and an engine compartment 30. Conventional controls (not shown) for driving the stoneblower 10 along the track are located at the front of the operator compartment 26. Controls for operating the jackbeam 16 and workheads 22 are located at the rear of the operator compartment overlooking the workhead section 28 of the stoneblower 10. These controls are described in more detail below. The workhead section 28 is located directly behind the operator compartment 26. The workheads 22 and jackbeam 16 are mounted to the superstructure 12 in the workhead section 28, where their operation is visible from the location of their controls in the operator compartment 26. The engine compartment 30 is located immediately behind the workhead section 28. The main engine 32, air compressor 34, battery box 36, hydraulic mechanisms 38, fuel tank 40 and other components are located in the engine compartment 30. The superstructure 12 includes a framework of support beams, including left and right lower support beams 42*a–b* that extend longitudinally along opposite sides of the operator compartment 26, left and right intermediate support beams 44*a–b* that extend longitudinally along opposite sides of the workhead section 28 and left and right upper support beams 46*a–b* that extend longitudinally along opposite sides of the workhead section 28 and the majority of the engine compartment 30. The lower support beams 42*a–b,* intermediate support beams 44*a–b* and upper support beams 46*a–b* are interconnected by a plurality of vertical support beams 48. A plurality of lateral support beams 50 interconnect the left and right support beams 42*a–b,* 44*a–b* and 46*a–b*. A pair of workhead support beams 62*a–b* extend longitudinally between the lateral support beams 50. As described in more detail below, the workheads 22*a–d* are pivotally mounted to the workhead support beams 62*a–b*. The described superstructure 12 is merely exemplary, and its design and configuration may vary from application to application.

Figure 7:
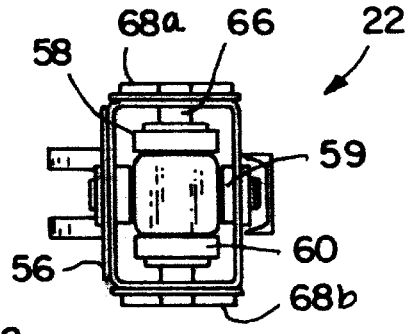
FIG. 7 is a top plan view of the workhead.
Figure 5:
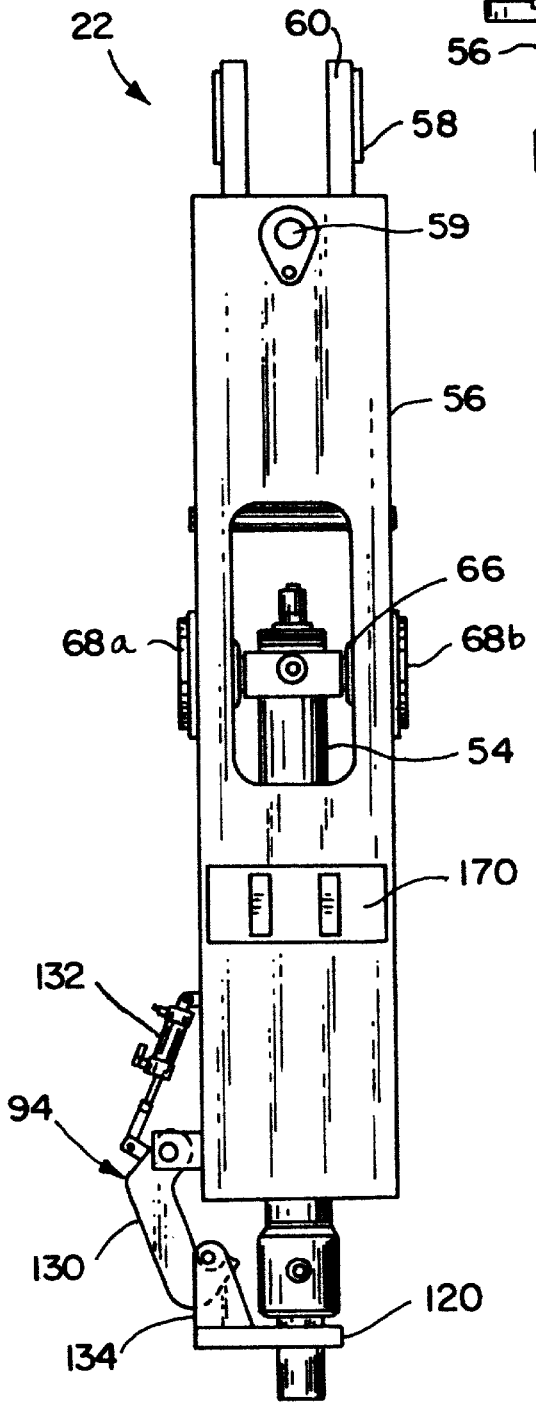
FIG. 5 is front elevational view of the workhead.
Figure 6:
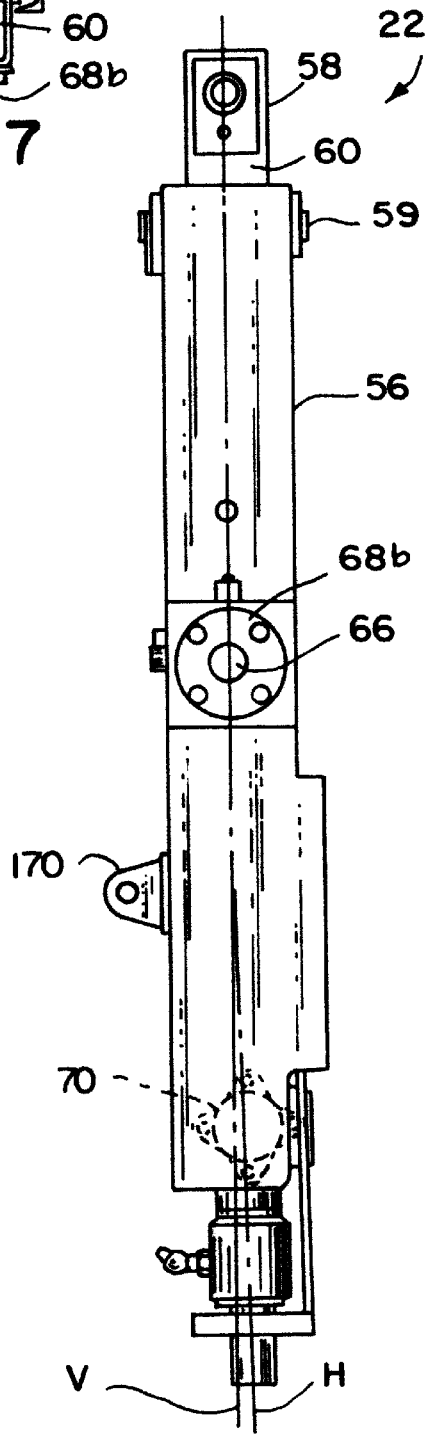
FIG. 6 is a side elevational view of the workhead.
Figure 9:
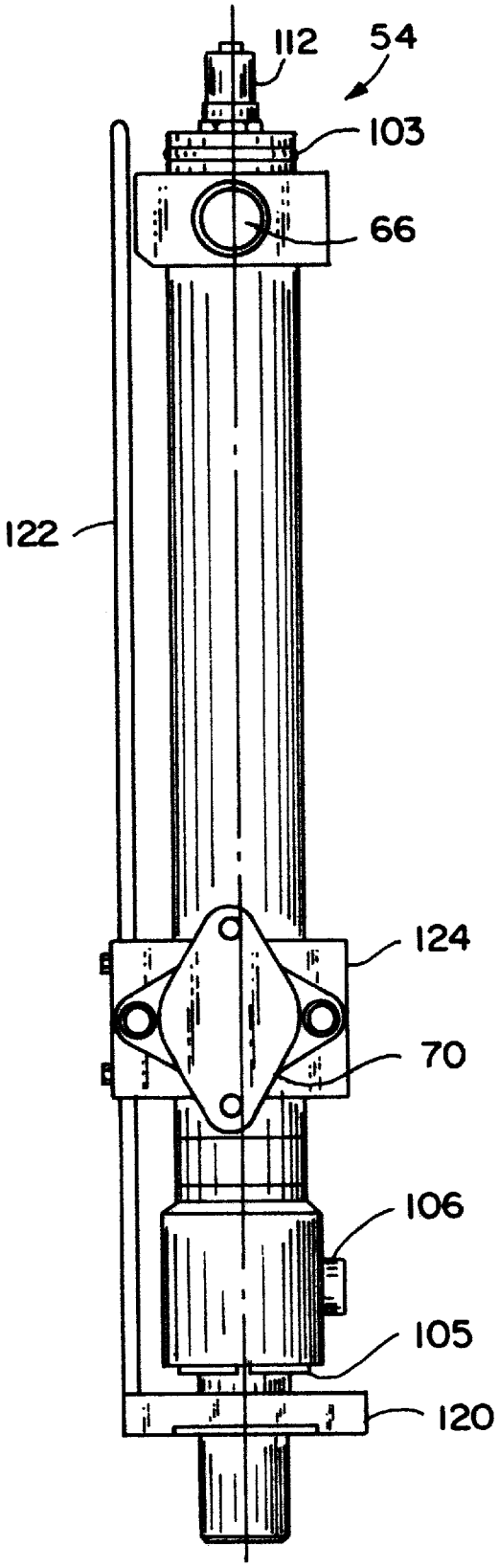
FIG. 9 is a side elevational view of the vertical cylinder.
Figure 8:
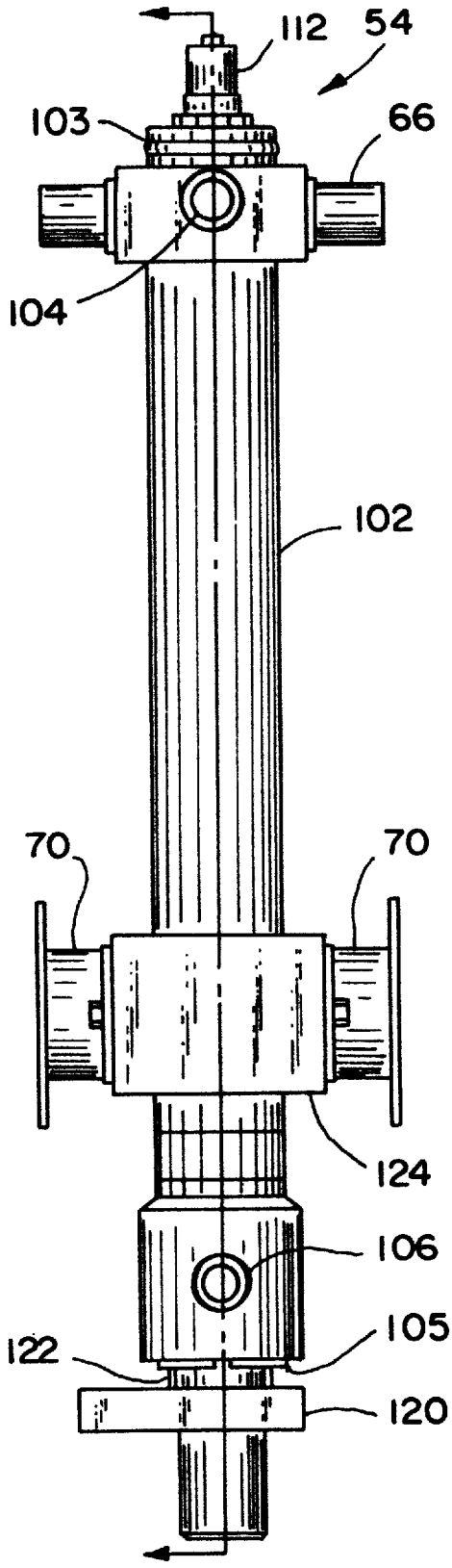
FIG. 8 is a front elevational view of the vertical cylinder.
Figure 18:
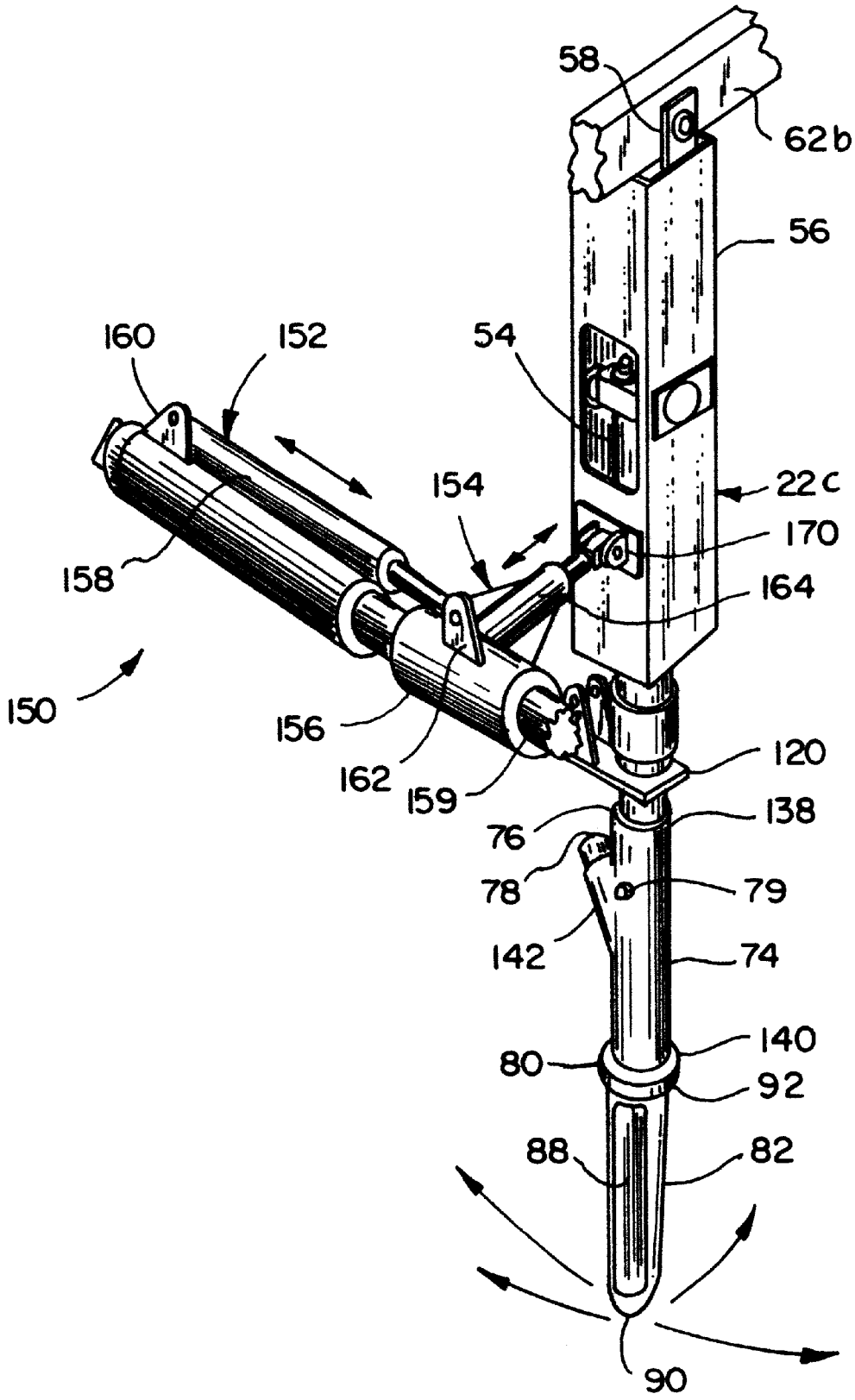
FIG. 18 is a perspective view of a workhead an actuating assembly.

The stoneblower 10 preferably includes four workheads 22*a–d,* arranged in left and right pairs. Each pair including a forward workhead 22*a* and 22*c* with a single blowing tube opening rearwardly and a rear workhead 22*b* and 22*d* with a single blowing tube opening forwardly. The workheads 22*a–d* are positioned on opposite sides of a tie T to blow stone under the tie from opposite directions. A single workhead 22 is illustrated in FIG. 18. The workhead 22 includes a vertical cylinder 54 mounted within a rectangular sleeve 56 (See FIGS. 5–7). The sleeve 56 is mounted to the superstructure 12 by a universal joint 58 that permits the workhead 22 to pivot both laterally and longitudinally. The universal joint 58 includes a mounting rod 58 fixedly secured to the upper end of the sleeve 56. A clevis 60 is pivotally mounted on the rod 58 using conventional bearings or bushings (not shown). The clevis 60 is in turn pivotally mounted to the corresponding workhead support beam 62*a* or 62*b* extending between lateral support beams 64 and 65, again using conventional bearings or bushings (not shown). The vertical cylinder 54 is pivotally mounted within the rectangular sleeve 56 (See FIGS. 8–11). The upper end of the vertical cylinder 54 is pivotally mounted to the approximate center of the sleeve 56 on axle 66. The axle 66 is rotatably received within fittings 68*a–b* that house appropriate bearings or bushings (not shown). This provides the vertical cylinder 54 with a limited range of forward and rearward pivotal motion, which as described below is used in sensing the location of a tie. A pair of resilient couplings 70 interconnect the vertical cylinder 54 and the sleeve 56 just inside the bottom of sleeve 56 to bias the vertical cylinder 54 in a home position within the sleeve 56. The couplings 70 are preferably secured to the vertical cylinder 54 by collar 124. As perhaps best shown in FIG. 6, the home position H is preferably offset 1° from the vertical axis V of the rectangular sleeve 56 toward the direction of the blowing tube opening. As described in more detail below, this 1°

"pre-tilt" permits the vertical cylinder and rectangular sleeve 56 to come into vertical alignment once the vertical cylinder tilts 1° upon engagement with a tie face. The couplings 70 are preferably manufactured from rubber or other similarly flexible and resilient materials. A transducer 72 or other similar sensing device is mounted to the vertical cylinder 54 and sleeve 56 to sense pivotal movement of the vertical cylinder 54 with respect to the sleeve 56. The lower end of the vertical cylinder 54 protrudes from the sleeve 56 to receive a blowing tube holder 74.

The vertical cylinder 54 is extended and retracted using conventional hydraulics. Referring now to FIGS. 8–11, the vertical cylinder 54 includes rod 100 slidably fitted within cylinder wall 102. The cylinder wall 102 includes a closed end 103 and an open end 105. A ring 108 and ring seal 109 are fitted within the open end 105 to close the cylinder wall 102. A pair of conventional fittings 104 and 106 are mounted in opposite ends of the cylinder wall 102 to supply and exhaust hydraulic fluid in a conventional manner. A piston 110 is secured to the inner end of the rod 100 to divide the interior of the cylinder wall 102 into two distinct voids. A stop tube 111 is fitted over the rod 100 adjacent the piston 110. The stop tube 111 engages the inner surface of the ring seal 108 to limit the stroke of the rod 100. A conventional transducer 112 is mounted through the closed end 104 of the cylinder wall 102. The transducer 112 includes a shaft 114 that extends into a concentric bore 116 defined in the center of rod 100 and a ring 118 that is mounted to the rod 100 around shaft 114. The transducer 112 provides accurate measurement of the position of the rod 100 within the cylinder wall 102, and consequently of the vertical position of the blowing tube 82. A collar 120 is attached to the lower end of the rod 100 outside of the cylinder wall 102. A guide rod 122 is rigidly affixed to the collar 120. A second collar 124 is mounted to the cylinder wall 102. The second collar 124 defines a guideway 126 that slidably receives the guide rod 122. Cooperatively, these components prevent the rod 100 from rotating within the cylinder wall 102.

Figure 4:
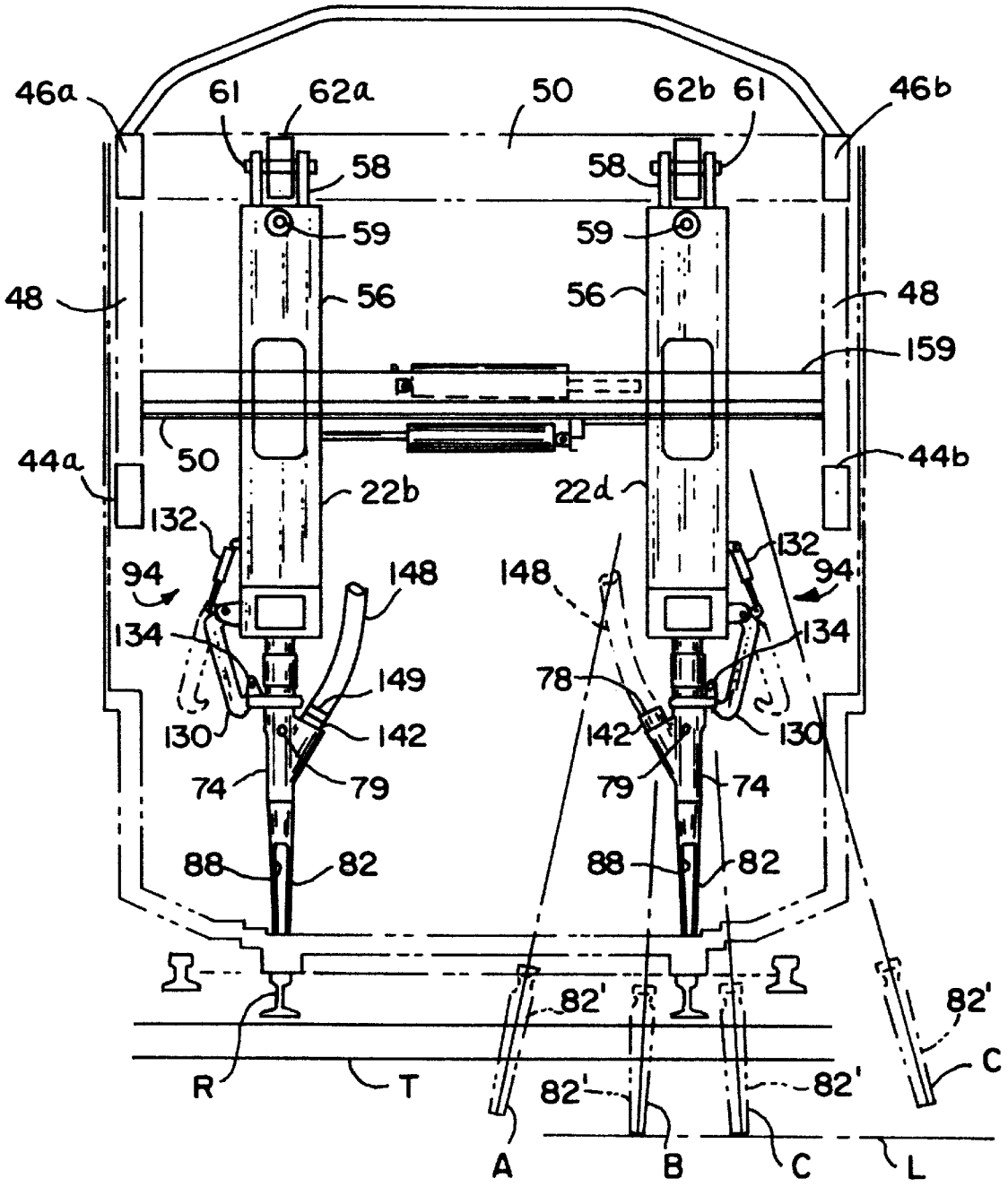
FIG. 4 is a partial sectional view of the stoneblower with portions removed taken along line IV—IV of FIG. 2.

The workhead 22 includes a latch assembly 94 for securing the blowing tube 82 in the raised position during travel (See FIG. 4). The latch assembly 94 includes a hook 130 that is pivotally secured to the rectangular sleeve 56 and a conventional hydraulic cylinder 132 for controlling movement of the hook 130. The latch assembly 94 further includes a catch 134 defined in collar 120. In operation, cylinder 132 can be extended to cause hook 130 to engage catch 134, thereby locking the blowing tube 82 in the raised position (See solid lines in FIG. 4) or retracted to disengage the hook 130 permitting extension of the vertical cylinder 54 (See phantom lines in FIG. 4).

In general, the blowing tube holder 74 is a vertically elongated tube having a top 138, a bottom 140 and a neck 142 protruding at an angle to the centerline of the blowing holder 74. The top 138 defines a mounting bore 76 that is fitted over and secured to the lower end of the sleeve 56. The bottom 140 includes a flange 80 adapted to mount a blowing tube 82 as described below. The neck 142 defines a stone inlet 78 to receive ballast stone and an air inlet 79 to receive pressurized air. A stone passageway 84 extends from the stone inlet 78 through the flange 80 to feed ballast stone to the blowing tube 82. An air passageway 83 extends from the air inlet 79 to the stone passageway 84. The pressurized air flows through the stone passageway 84 creating a partial vacuum that draws in stone and expels it through the blowing tube 82.

The blowing tube 82 is generally conventional and includes a vertically elongated tube having an inlet opening 86 formed in its upper end and a vertically extended exit opening 88 formed in the lower end. The lower tip 90 of the blowing tube is pointed and wedge shaped to facilitate penetration into the track ballast and to urge the blowing tube toward the tie face as the blowing tube is moved downwardly. A flange 92 extends around the blowing tube 82 to engage flange 80. The blowing tube 82 is secured to the blowing tube holder 52 by fasteners extending through flanges 92 and 80.

A flexible supply hose 148 is fitted over neck 142. The supply hose 148 is generally conventional and is preferably manufactured from readily available wire reinforced, abrasion-resistant plastic tubing. The supply hose 148 preferably includes an internal diameter of approximately three inches, or 75 mm, and is secured to the neck 142 by a conventional clamp (not shown). As described below, the supply hose 148 receives ballast stone from the stone metering device in a conventional manner. The stone and air are supplied to the blowing tube 82 through the blowing tube holder 52.

As noted above, the rectangular sleeve 56, and consequently the entire workhead 22*a–d,* is pivotally mounted for both longitudinal and lateral movement. The position of each workhead 22*a–d* is individually controlled by a separate actuating assembly 150 that is mounted to a lateral support tube 159. Referring now to FIGS. 15–18, the actuating assembly 150 includes a lateral adjustment assembly 152 and a longitudinal adjustment assembly 154. The lateral adjustment assembly 152 controls lateral or transverse pivotal movement of the workhead 22, and includes a sleeve 156 slidably fitted over the lateral support tube 159 and a lateral cylinder 158 for moving the sleeve 156 along tube 159. Bushings 172, bearings or other conventional friction reducing elements are fitted within the sleeve 156 to ease movement of the sleeve 156 along the tube 159. The lateral cylinder 158 is preferably a conventional hydraulic cylinder. The first end of the cylinder 158 is fixed to the lateral support tube 158 at ear 160 and the second end is fixed to the sleeve 156 at mounting ear 162. Both ends of the lateral cylinder 158 are attached using conventional spherical bushings to allow for slight pivotal movement of the sleeve 156 about the lateral support tube 158. A conventional linear transducer (not shown) is fitted within the lateral cylinder 158 to sense the lateral position of the workhead 22.

Figure 12:
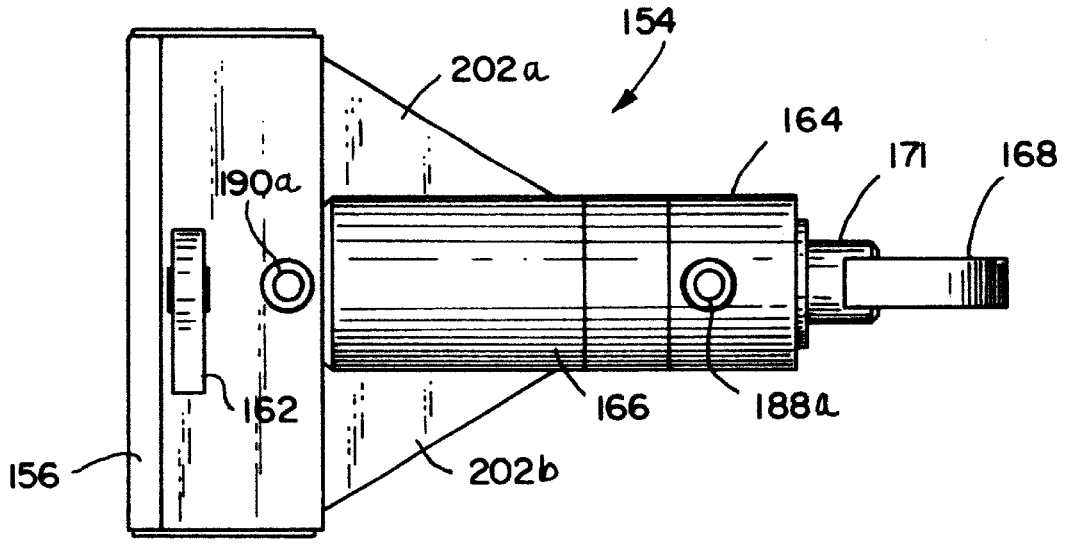
FIG. 12 is a top plan view of the longitudinal cylinder assembly.
Figure 13:
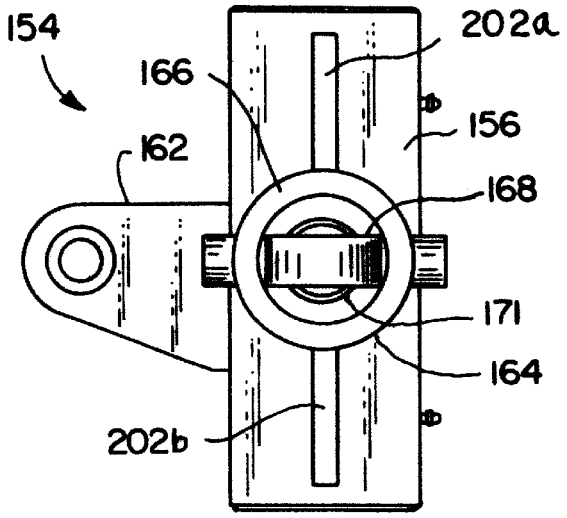
FIG. 13 is a front elevational view of the longitudinal cylinder assembly.
Figure 14:
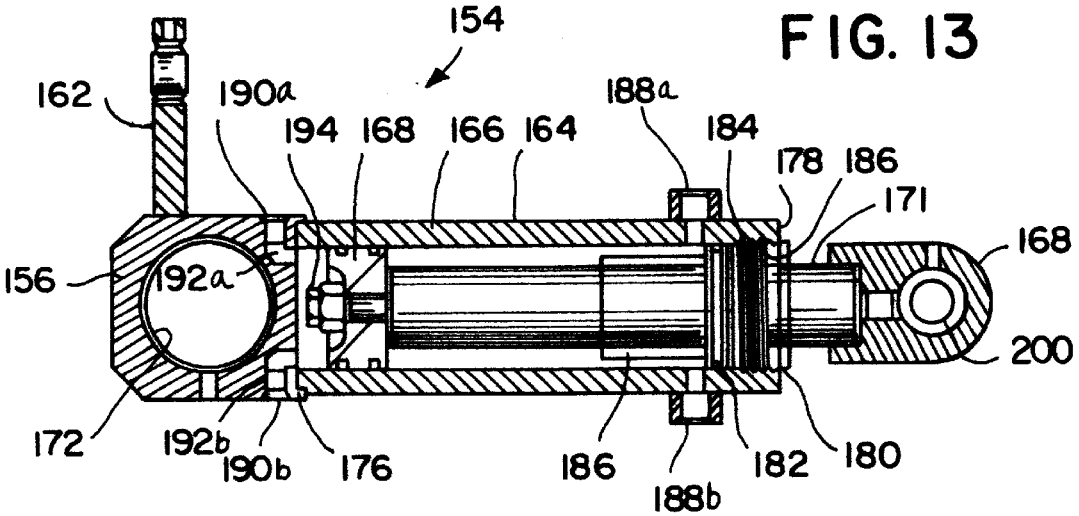
FIG. 14 is a sectional view of the longitudinal cylinder assembly taken along line XIV—XIV of FIG. 12.
Figure 16:
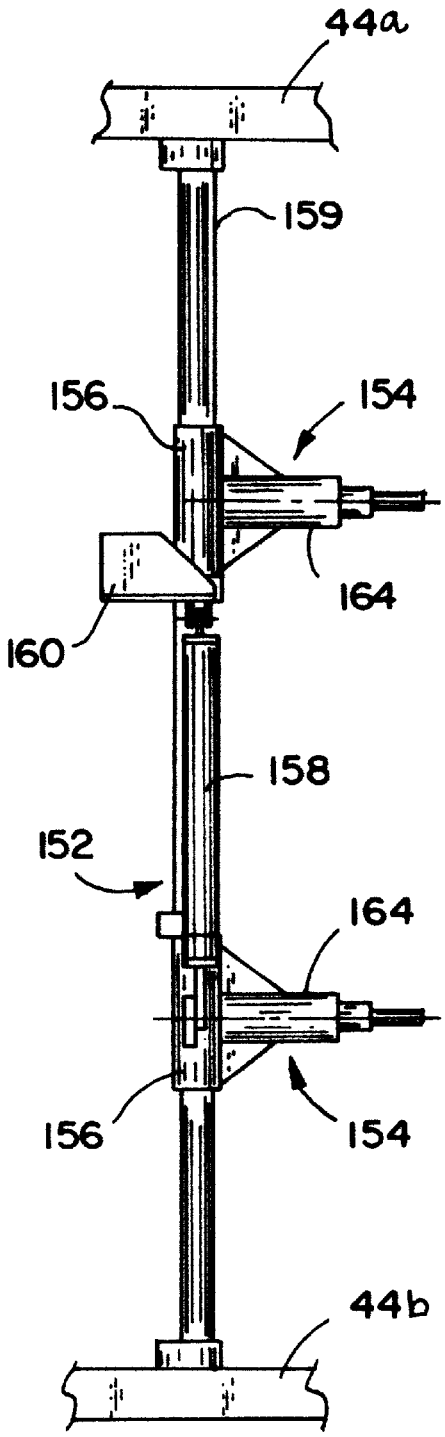
FIG. 16 is top plan view of a portion of the stoneblower showing the workhead actuating assembly.
Figure 15:
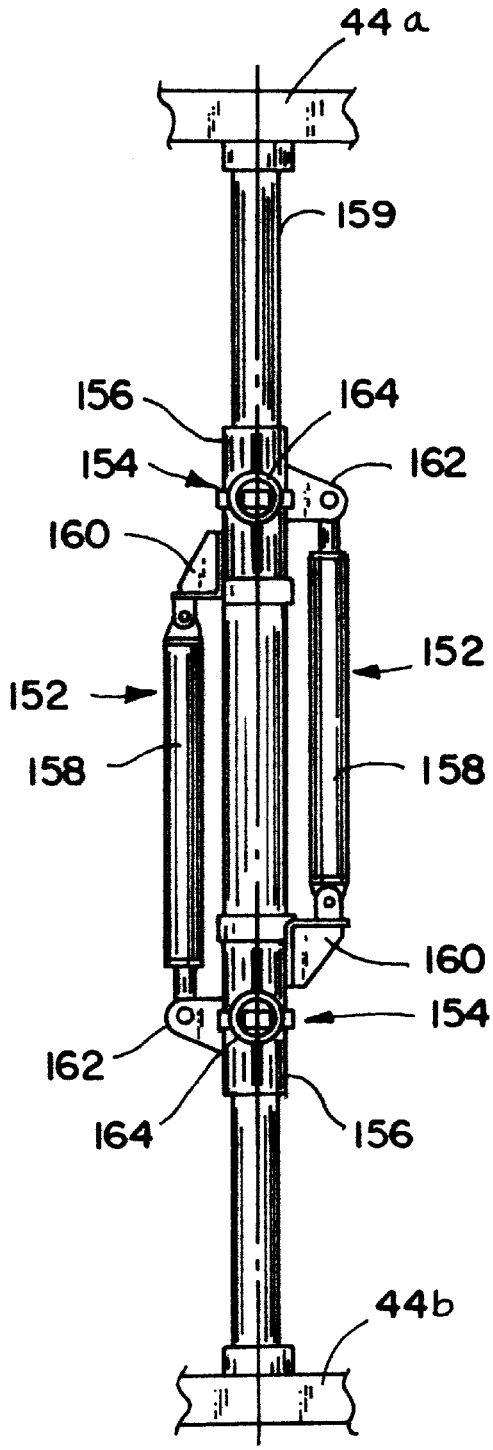
FIG. 15 is a side elevational view of a portion of the stoneblower showing the workhead actuating assembly.
Figure 17:
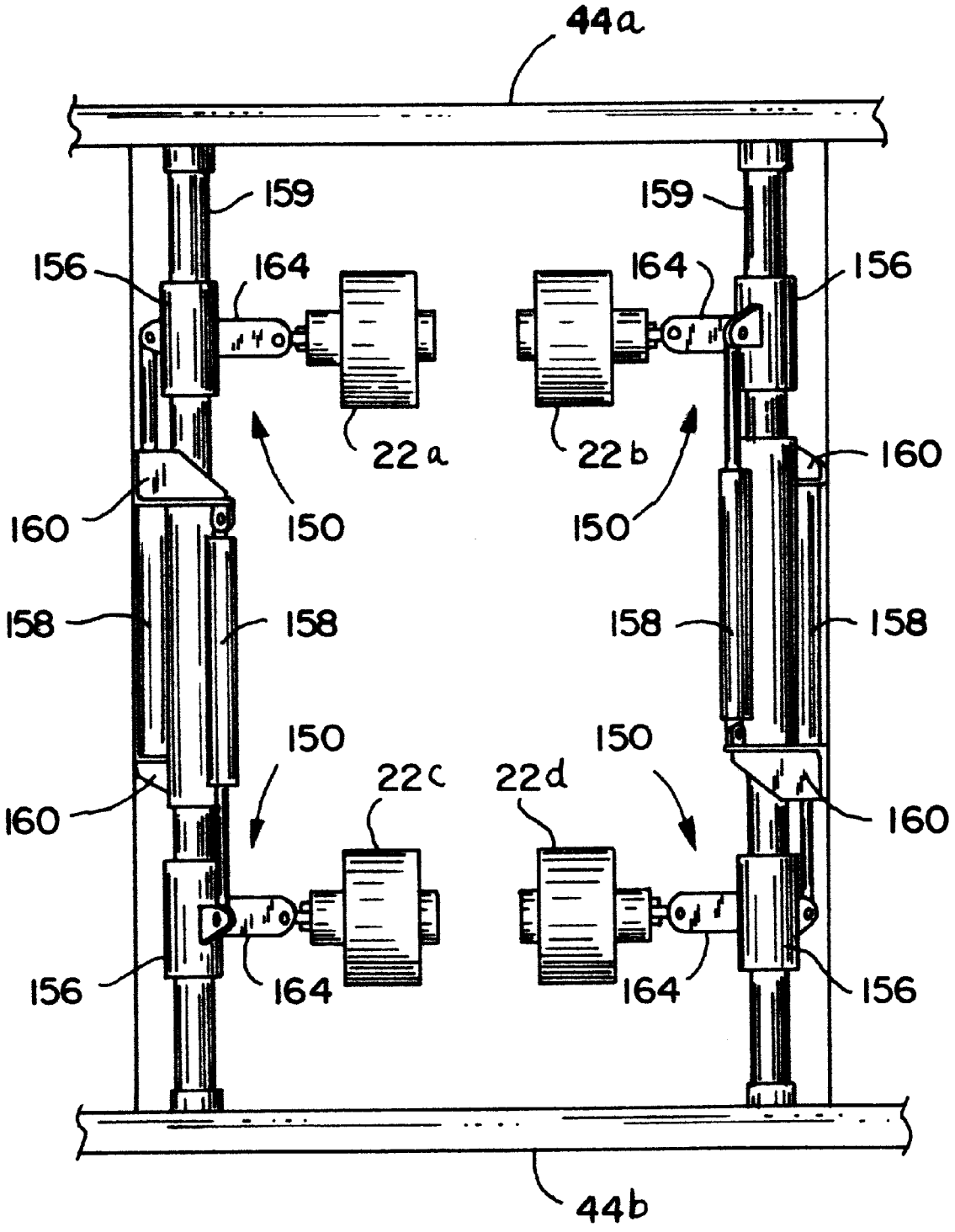
FIG. 17 is a top plan view of a central portion of the stoneblower with portions removed showing the workheads and the associated actuating assemblies.

The longitudinal adjustment assembly 154 controls fore and aft pivotal movement of workhead 22, and includes a longitudinal cylinder 164 secured to the sleeve 156. Referring now to FIGS. 12–14, the longitudinal cylinder 164 extends perpendicularly from the sleeve 156 and includes a cylinder wall 166, a piston 168 seated within the cylinder wall 166 and an extendible rod 171 interconnected with the piston 168. The cylinder wall 166 includes a closed end 176 and an open end 178. A ring 180 and ring seal 182 are fitted within the open end 178 to close the cylinder wall 166. The ring 180 includes an extended stop 186 that limits the stroke of the piston 168. The ring 180 further includes external threads 184 that engage internal threads 186 on the inner surface of the cylinder wall 166 to secure the ring 180 is place. A pair of conventional fittings 188*a–b* are mounted at the open end 178 of the cylinder wall 166 to supply and exhaust hydraulic fluid. A second pair of conventional fittings 190*a–b* are defined in the sleeve 156. Passageways 192*a–b* extend between fittings 190*a–b* and the closed end 176 of the cylinder wall 166 to supply and exhaust hydraulic fluid. The longitudinal cylinder includes two sets of fittings 188*a–b,* 190*a–b* so that at least one set of fittings (e.g. 188*a* and 190*a*) is readily accessible when the cylinder is installed on either the left or right side of the vehicle. The other set of fittings (e.g. 188*b* and 190*b*) is plugged when not in use. The piston 168 is generally conventional and is attached to the rod 170 in a conventional manner, such as by nut 194. The rod 170 protrudes from the cylinder wall 166 and includes a mounting clevis 168 affixed to its outer end 196. Conventional roller bearings 200 are fitted within the clevis 168. The clevis 168 is mounted to the rectangular sleeve 56 of the workhead 22 at ear 170 in a conventional manner, such as by pin. A pair of support plates 202*a–b* are mounted between the lateral sleeve 156 and the cylinder wall 166 to provide lateral strength to the assembly. A conventional transducer (not shown) is mounted external to the longitudinal cylinder 164 to sense the longitudinal position of the workhead 22.

The workheads 22*a–d* are controlled by a computerized control system (not shown). The controls include separate joystick controls (not shown) for the left pair of workheads 22*a–b* and the right pair of workheads 22*c–d*. The joysticks control the left/right and fore/aft movement of the workhead. Eachjoystick includes a workhead selector switch (not shown) that is moveable between a first position in which the joystick controls movement of the forward workhead and a second position in which the joystick controls movement of the rear workhead. One of the two joysticks may also be used to operate the jackbeam in a conventional manner by activating a jackbeam selector switch. Alternatively, a separate joystick can be provided for operating the jackbeam.

The control system also includes an automated height control system (not shown) for controlling the height of the blowing tubes 82. The automated height control system includes a uniform height control system (not shown) for positioning the blowing tubes 82 at a uniform height (e.g. in the same horizontal plane) despite the lateral disposition of the workheads 22*a–d*. Because the workheads 22*a–d* are mounted for pivotal movement, each blowing tube 82 inherently travels through an arc as it pivots left/right. Accordingly, the real height of the blowing tubes 82 for any given position of the vertical cylinder 54 would normally vary depending on the position of the workhead 22*a–d* in this arc. This would complicate operation of the stoneblower because, in order to position the blowing tube 82 at a uniform height, it would require variation in the position of the vertical cylinder 54 for any variation in the lateral position of the workhead. For example, FIG. 4 shows the blowing tube 82' in phantom lines at four different pivotal positions, A, B, C, and D with the vertical cylinder 54 at a given position. As can be seen, the height of the blowing tube 82' varies significantly from horizontal line L between the different positions A, B, C, and D. To address this problem, the automated height control system (not shown) automatically adjusts the vertical cylinder 54 to compensate for variations in the left/right position of the workhead 22. In the preferred embodiment, the necessary variation in the position of the vertical cylinder 54 is computed by the formula: $E = |(D/\cos\theta) - D$ FIG.l, where E is the additional amount of extension necessary to compensate for the lateral position of the workhead, D is the vertical distance from the pivot point of the workhead to the bottom of the tie T, and $\theta$ is the angle of the workhead away from its vertical center. The vertical position of the raised tie T is measured in a conventional manner by the stoneblower reference system. Because the ties have a uniform height, the location of the bottom of the tie is easily computed from the measured value. The value of $\theta$ is determined by the transducer (not shown) of the lateral cylinder 158. In operation, the workhead 22*a–d* will be positioned so that a point 40 millimeters from the bottom of the blowing tube exit opening 88 along its vertical centerline is aligned with the bottom of the tie T. The value of 40 millimeters is used in the preferred embodiment in part because it provides adequate stone flow. This value may, however, vary from application to application. Accordingly, the uniform height control system varies the position of the vertical cylinder 54 so that a point along the vertical centerline of the blowing tube 40 mm above the bottom of the exit opening 88 aligns with the bottom surface of the tie T at all left/right pivotal locations of the workhead 22*a–d*. The automated height control system may be configured to compensate for fore/aft movement as well as left/right movement of the workhead in a similar manner, for example, by also extending and retracting the vertical cylinder in response to fore/aft movement of the workhead.

Figure 2:
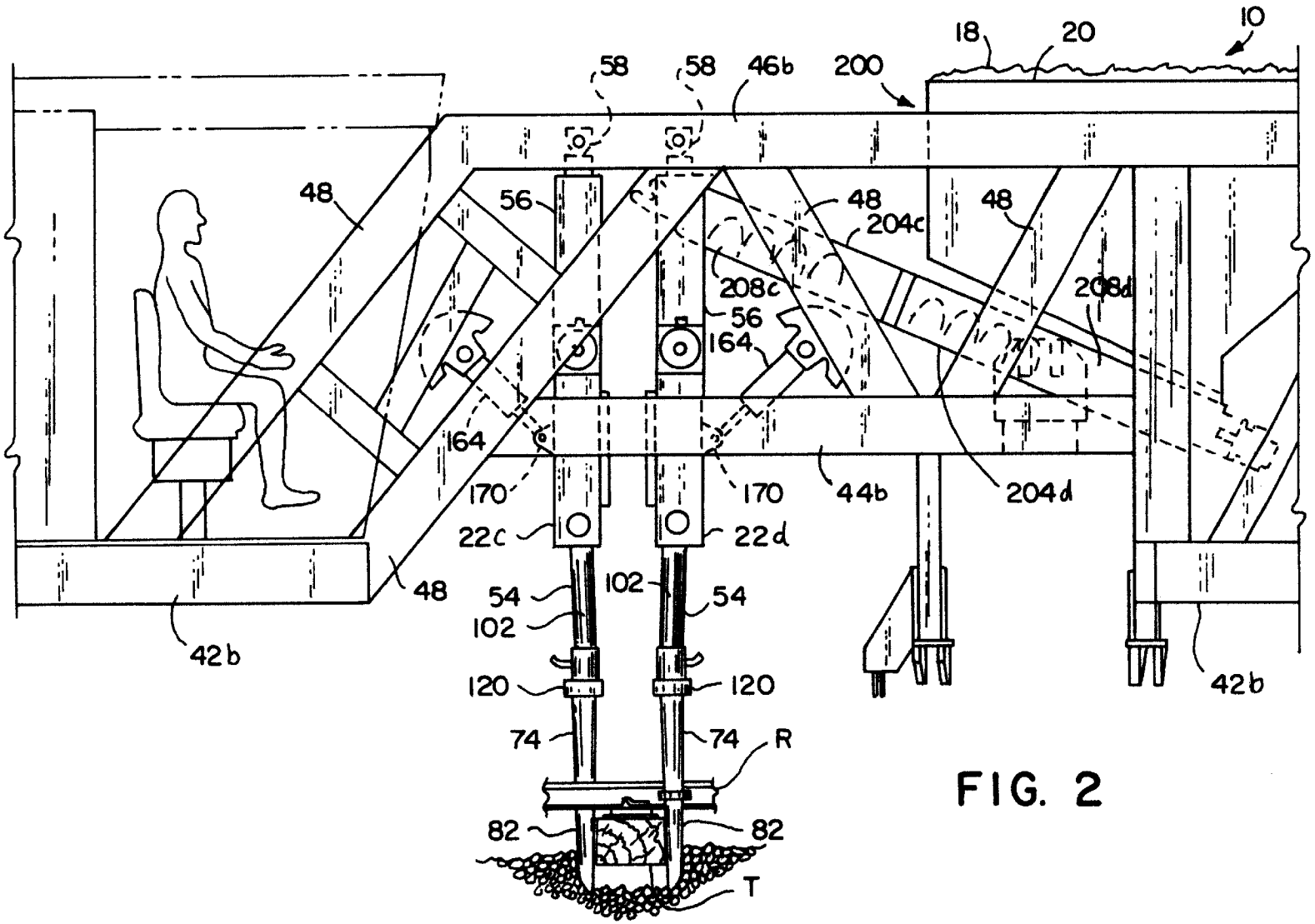
FIG. 2 is an enlarged side elevational view of a central portion of the stoneblower.
Figure 10:
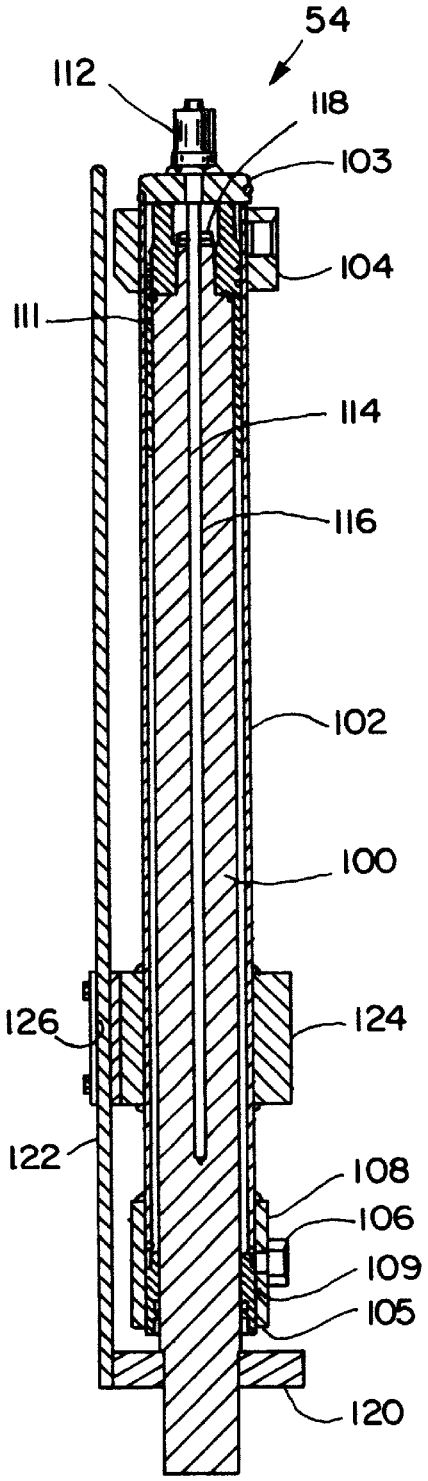
FIG. 10 is a section view of the vertical cylinder taken along line X—X of FIG. 8.
Figure 11:
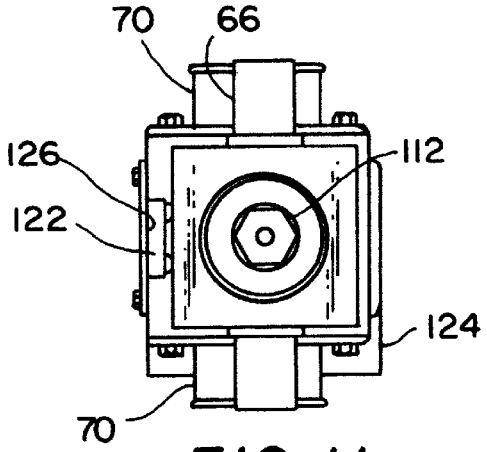
FIG. 11 is a top plan view of the vertical cylinder.
Figure 3:
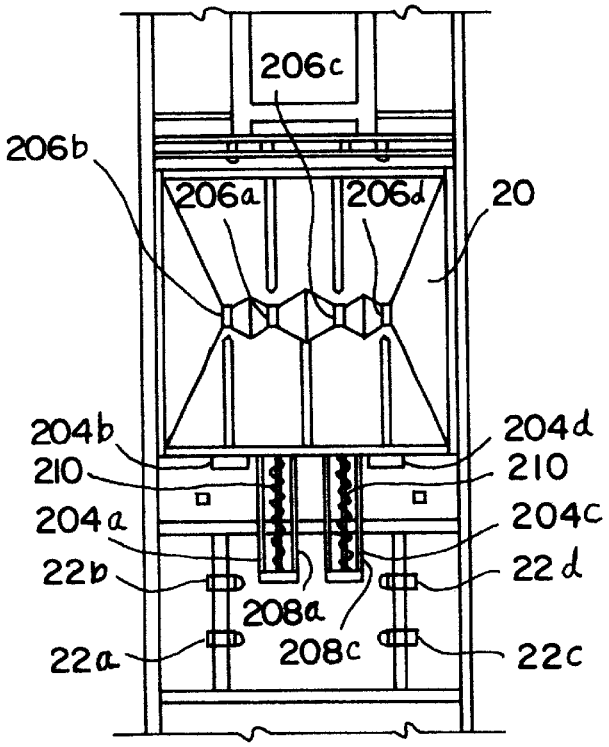
FIG. 3 is a top plan view of a central portion of the stoneblower.

Referring now to FIGS. 1–3, the stoneblower 10 includes a stone supply system 200 for supplying stone to the workheads 22*a–d*. In the preferred embodiment, the stone supply system 200 includes a stone hopper 20 and four metering augers 204*a–d*. The stone hopper 20 stores a supply of ballast stones 18 and includes four outlets 206*a–d*—one communicating with each of the four stone metering augers 204*a–d*, respectively. The stone hopper 20 feeds stone into the stone metering augers 204*a–d* through outlets 206*a–d* by gravity. The stone metering augers 204*a–d* are generally conventional and function to supply ballast stone to the workheads 22*a–d*, respectively. Each stone metering auger 206*a–d* includes a casing 208*a–d* having an inlet (not shown) positioned directly below the corresponding stone hopper outlet 206*a–d* and an outlet (not shown) at the opposite end of the casing 208*a–d* through which metered stone flows into the supply hose 148. A screw 210 is rotatably supported within the casing 208*a–d* of each stone metering auger 206*a–d* to both meter the stone and move it from the inlet to the outlet (See FIG. 3). From the outlet, the stone falls into the supply hose 148 where it is drawn by gravity and air entrainment into the blowing tubes 82. The described stone supply system 200 is merely exemplary and may be replaced by virtually any system capable of supplying metered stone to the workhead. For example, the stone metering augers 204*a–d* can be replaced by other conventional stone metering devices and the stone hopper 20 can be replaced by other conventional ballast stone storage devices.

Operation

For simplicity and clarity, the operation of the present invention is described in connection with the operation of a single workhead during maintenance of a switch. It should be readily apparent that the operation may be extended to virtually any number of workheads.

The stoneblower is particularly well suited for use in maintaining switches and other complex track configurations. As noted above, the profile of the track is measured using any of a variety of well-known rail profiling techniques. From the profile, the ties requiring maintenance are identified and the volume of ballast stone to be blown beneath each of those ties is computed. The stoneblower is then manually moved over the rails to the appropriate location to perform maintenance on the first tie requiring maintenance. After the stoneblower has traveled to the location requiring maintenance and prior to positioning of the workhead, the latch assembly 94 must be moved into the unlocked position (See phantom lines in FIG. 4). The latch assembly 94 is operated by conventional controls, such as a toggle switch (not shown) located near the joystick controls. The latch assembly 94 preferably remains unlocked while the stoneblower performs maintenance on and indexes through the section of track requiring maintenance. The latch assembly 94 is locked again after maintenance is stopped and the stoneblower is ready to travel.

Once the stoneblower is properly positioned along the track, the rails and attached ties are lifted using the jackbeam 16. The jackbeam 16 is preferably operated using a generally conventional joystick (not shown). The jackbeam 16 may share a joystick with one of the workhead pairs, as noted above. The jackbeam 16 is manually positioned adjacent to the rails using the joystick in a conventional manner. Once positioned, the user depresses the jackbeam cycle button (not shown) and the jackbeam control system automatically clamps and lifts the rails in a conventional manner to the height desired to perform maintenance.

Once the rails and ties are lifted, the workheads 22*a–d* are moved into position to blow the appropriate volume of ballast stone beneath the raised ties. The workheads 22*a–d* are positioned using generally conventional joysticks (not shown), and can be moved into position in any order.

Depending on the track profile, it may not be necessary to use all of the workheads 22*a–d* at a given location. For example, if the right side of the tie has settled while the left side has maintained the desired height, it may only be necessary to supply stone under the right side of that tie. Consequently, it may only be necessary to position and supply stone through the right workheads 22*c–d*. Movement of the joystick sends control signals to the computerized control system. The control system interprets the signals and either extends or retracts the appropriate cylinder or cylinders. For example, with the rear workheads 22*b* and 22*d*, rearward movement of the joystick results in retraction of the corresponding longitudinal cylinder and hence rearward movement of the workhead 22*b* and 22*d*. Similarly, with the left pair of workheads 22*a–b*, leftward movement of the joystick results in extension of the corresponding lateral cylinder and hence leftward movement of the workheads 22*a–b*. With the right pair of workheads 22*c–d*, leftward movement of the joystick results in retraction of the corresponding lateral cylinder and hence leftward movement of the workheads 22*a–b*.

In operation, the joystick is manipulated to manually move the workhead 22*a–d* into a position adjacent the tie T where maintenance is to be performed. The blowing tube 82 is positioned at the desired lateral position a small distance from the face of the tie T. Once the workhead 22*a–d* is properly positioned, the user depresses the workhead cycle button (not shown) to activate the control system. Upon depression of the workhead cycle button, the control system automatically moves the blowing tube 82 into engagement with the tie face and then thrusts it down into the ballast to the desired height. More specifically, the control system first swings the workhead 22*a–d* toward the tie by extending or retracting the longitudinal cylinder 164 until it determines that the blowing tube 82 has engaged the tie face. As noted above, the vertical cylinder is provided with a 1° pre-tilt which permits the vertical cylinder to pivot 1° with respect to the rectangular sleeve 56 upon contact with a tie face during positioning. This 1° pivot is used as a key to indicate that a tie has been located. In operation, the workhead 22*a–d* travels freely until it engages the face of the tie T. Continued movement of the workhead 22*a–d* toward the tie causes the vertical cylinder 54 to pivot with respect to the rectangular sleeve 56. The longitudinal transducer (not shown) senses relative movement between the vertical cylinder 54 and the sleeve 56 and provides corresponding signals to the computer control system. Once these signals indicate that the vertical cylinder 54 has pivoted 1° with respect to the sleeve 56, the computer control system stops movement of the workhead 22*a–d* toward the tie and then lowers the blowing tube into the ballast to the desired height.

As noted above, the vertical position, or height, of the workhead 22*a–d* is controlled by the automated control system. The control system extends or retracts the vertical cylinder 54 to position the blowing tube at the desired height. Experience has revealed that it is desirable to position the blowing tubes 82 so that the area of the exit opening 88 positioned below the tie is consistent. This reduces the likelihood of clogging and facilitates proper stone metering. As noted above, the vertical cylinder 54 is preferably positioned so that a point along the vertical centerline of the blowing tube 40 mm above the bottom of the exit opening 88 is aligned with the bottom surface of the tie T. This distance may, however, vary from application to application. The desired depth of the blowing tubes will be input into the control system, typically prior to maintenance. The uniform height control system (not shown) facilitates uniform vertical positioning of the blowing tubes 82 by automatically adjusting the height of the blowing tube 82 to compensate for left/right movement of the workhead. After depression of the workhead cycle button, the control system determines the lateral position of the workhead by way of the linear transducer (not shown) of the lateral cylinder 158. The uniform height control system then computes any variation in the position of the vertical cylinder 54 necessary to compensate for the lateral position of the workhead 22*a–d*. As noted above, the vertical position of the raised tie T is measured by the stoneblower reference system (not shown) and serves as a reference point for use in computing any necessary variation in the position of the vertical cylinder 54. Once this value is computed, the uniform height control system automatically extends the vertical cylinder 54 the computed amount, thereby driving the blowing tube 82 down into the ballast to the desired vertical position. In the preferred embodiment, the uniform height control system does not compensate for fore and aft movement of the workhead, but that capability may be added as desired. After the workhead(s) 22*a–d* is properly positioned, the stone supply system 200 is operated to supply the desired volume of stone to the workhead(s) 22*a–d*. The volume of stone supplied to each workhead 22*a–d* is preferably dictated by automated control. The control system (not shown) uses the information collected from the measured track profile to determine the appropriate amount of stone for each workhead 22*a–d*. The control system (not shown) supplies the appropriate volume of stone to a given workhead 22*a–d* by operating the stone metering device for that workhead 22*a–d* (e.g. the stone metering auger 204*a–d*) at a specified supply rate for a specified period of time.

Once the desired volume of stone has been blown beneath the tie, the control system automatically stops the stone supply system 200 and raises the workheads 22*a–d* into a home position by retracting the vertical cylinder 54. The home position is high enough for the blowing tubes 82 to clear the ties as the stoneblower moves along the track. The jackbeam 16 then lowers the track, and the stoneblower 10 is ready to move, or index, along the track to the next location requiring maintenance. This cycle is typically repeated for the entire length of track requiring maintenance. Once maintenance is complete or it is otherwise necessary for the stoneblower to travel from the section of track being maintained, the workheads 22*a–d* are fully raised and the latch assembly 94 for each is locked.

The stoneblower 10 is also well suited for maintaining plain line track. When operating on plain line track, the stoneblower's movement along the track is largely automated and operates under computer control. The superstructure 12 moves along the track by indexing movement with respect to the ties. At each indexed location, the workheads 22*a–d* are moved into the appropriate location to perform maintenance manually.

The computer control directs movement of the stoneblower based on track profile data provided by the track measuring system. As noted above, the track profile data is collected prior to and/or during the maintenance pass of the stoneblower. The computer control processes the track profile data to determine which ties require maintenance. As the stoneblower moves along the track, the computer control stops the stoneblower at the appropriate ties to perform maintenance. First, the jackbeam 16 is used to lift the rail and attached ties. The jackbeam 16 operates in generally the same manner as described above. After the rail is lifted, the appropriate workhead or workheads 22*a–d* are positioned in generally the same manner as described above to supply stone to the desired location under the lifted tie. As described above, the 1° pre-tilt of the vertical cylinder is used to position workhead 22*a–d* with respect to the face of the tie. Once properly positioned, the stone supply system 200 supplies the desired volume of stone. After the appropriate volume of stone has been supplied, the workheads 22*a–d* are raised into the home position and the track is lowered. The stoneblower 10 is then ready to move along the track to the next location requiring maintenance. The above description is that of a preferred embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A track maintenance vehicle comprising:

a superstructure adapted to ride on rails and having a maximum height above the rails, said superstructure further having a pivot location disposed at a height above the rails that is greater than about 75% of said maximum height;

a workhead mounted on said superstructure, said workhead having a top portion pivotally attached to said pivot location and a bottom portion terminating in a blowing tube; and an actuating means for controlling pivotal movement of said workhead, said actuating means carried by said superstructure and operable to cause pivotal movement of said workhead with respect to said superstructure about said pivot location.

2. The vehicle of claim 1 wherein said superstructure has an upper extent, said pivot location being located toward said upper extent.

3. The vehicle of claim 2 wherein said workhead includes a vertical cylinder, said blowing tube mounted on said vertical cylinder; and further comprising a control means for extending and retracting said vertical cylinder to control a height of said blowing tube.

4. The vehicle of claim 3 wherein said workhead includes first and second portions, said second portion capable of pivotal movement with respect to said first portions, said workhead further including a bias means for biasing said second portion into a home position with respect to said first portion.

5. The vehicle of claim 4 wherein said actuating means includes a lateral adjustment means for controlling a lateral position of said workhead.

6. The vehicle of claim 5 wherein said lateral adjustment means includes a lateral cylinder extending between said superstructure and said workhead, said lateral cylinder being extendable and retractable to pivot said workhead about said pivot location and vary a lateral disposition of said workhead.

7. The vehicle of claim 6 wherein said actuating means includes a means for sensing said lateral disposition of said workhead.

8. The vehicle of claim 7 wherein said actuating means includes a longitudinal adjustment means for controlling a longitudinal position of said workhead, said longitudinal adjustment means including a longitudinal cylinder extending between said superstructure and said workhead, said longitudinal cylinder being extendable and retractable to pivot said workhead about said pivot location and vary a longitudinal disposition of said workhead.

9. The vehicle of claim 8 comprising at least two of said workheads and at least two of said actuating means, each of said actuating means being uniquely associated with and controlling the disposition of one of said workheads.

10. The vehicle of claim 9 wherein said blowing tubes each define an exit opening, said workheads arranged in corresponding pairs, said corresponding workheads being spaced apart and aligned in a longitudinal direction, said exit openings of said blowing tubes of said corresponding workheads opening toward one another.

11. The vehicle of claim 1 further comprising a means for positioning said blowing tube at a uniform height despite pivoting movement of said workhead, said means for positioning including means for adjusting a height of said workhead to compensate for said lateral disposition.

12. A workhead for use in maintaining a railroad track comprising:

a vertically elongated body having a top portion and a bottom portion, said top portion being approximately the top 25% of said vertically elongated body;

a pivot means for permitting lateral and longitudinal pivotal movement of the body, the pivot means attached to said top portion and adapted to mount to a superstructure; and a blowing tube mounted to said bottom portion of said body.

13. The workhead of claim 12 wherein only a single blowing tube is mounted to said body.

14. The workhead of claim 13 wherein said body includes a vertical cylinder, said cylinder being extendable and retractable to permit selective vertical movement of said blowing tube.

15. The workhead of claim 14 wherein said vertical cylinder includes a cylinder and a rod, said blowing tube affixed to and carried by said rod.

16. The workhead of claim 15 wherein said body includes a sleeve having an upper end and a lower end, said vertical cylinder mounted within said sleeve and protruding from said lower end of said sleeve, said pivot means mounted to said upper end of said sleeve.

17. The workhead of claim 15 wherein said body includes a sleeve having an upper end and a lower end, said vertical cylinder pivotally mounted within said sleeve and protruding from said lower end of said sleeve, said pivot means mounted to said upper end of said sleeve.

18.The workhead of claim 17 wherein said body includes a bias means for biasing said cylinder in a home position with respect to said sleeve.

19. The workhead of claim 18 further comprising a sensor means for sensing relative movement of said vertical cylinder with respect to said sleeve.

20. The workhead of claim 19 further comprising an actuating means for controlling pivotal movement of said body about said pivot means, said actuating means adapted to be carried by the superstructure and operable to cause pivotal movement of said workhead with respect to the superstructure about said pivot means.

21. The workhead of claim 20 wherein said actuating means includes a lateral adjustment means for controlling a lateral position of said workhead.

22. The workhead of claim 21 wherein said lateral adjustment means includes a lateral cylinder adapted to extend between the superstructure and said body, said lateral cylinder being extendable and retractable to pivot said workhead laterally about said pivot means and vary a lateral disposition of said workhead.

23. The workhead of claim 22 wherein said actuating means includes a means for sensing said lateral disposition of said workhead.

24. The workhead of claim 23 wherein said actuating means includes a longitudinal adjustment means for controlling a longitudinal position of said workhead, said longitudinal adjustment means including a longitudinal cylinder adapted to extend between the superstructure and said body, said longitudinal cylinder being extendable and retractable to pivot said workhead longitudinally about said pivot means and vary a longitudinal disposition of said workhead.

25. The workhead of claim 24 further comprising means for positioning said blowing tube at a uniform height despite pivoting movement of said workhead, said means for positioning including means for adjusting a height of said workhead to compensate for said lateral disposition.

26. The workhead of claim 25 wherein said means for positioning extends and retracts said vertical cylinder in response to data collected from said means for sensing a lateral disposition.

27. A track maintenance vehicle comprising:

a superstructure supported on a plurality of wheels and having a maximum height above the rails, said superstructure including a first portion having a height above the rails that is greater than about 75% of said maximum height and a second portion located vertically lower than said first portion;

a vertically elongated workhead, said workhead having a top portion pivotally attached to said first portion of superstructure at a pivot location and a bottom portion terminating in a single blowing tube; and an actuating means for controlling pivotal movement of said workhead about said pivot location, said actuating means mounted to said second portion of said superstructure and operable to cause pivotal movement of said workhead with respect to said superstructure about said pivot location.

28. The vehicle of claim 27 wherein said actuating means includes a lateral adjustment means for controlling a lateral position of said workhead, said lateral adjustment means including a lateral cylinder extending between said superstructure and said workhead, said lateral cylinder being extendable and retractable to pivot said workhead about said pivot location and vary a lateral disposition of said workhead.

29. The vehicle of claim 28 wherein said actuating means includes a longitudinal adjustment means for controlling a longitudinal position of said workhead, said longitudinal adjustment means including a longitudinal cylinder extending between said superstructure and said workhead, said longitudinal cylinder being extendable and retractable to pivot said workhead about said pivot location and vary a longitudinal disposition of said workhead.

30. The vehicle of claim 27 wherein said actuating means includes:

a lateral sleeve movably mounted to said second portion of said superstructure;

a lateral cylinder having a first end mounted to said second portion of said superstructure and a second end mounted to said sleeve, said lateral cylinder being extendable and retractable to move said lateral sleeve laterally with respect to second portion; and a longitudinal cylinder having a first end mounted to said sleeve and a second end mounted to said workhead, said longitudinal cylinder being extendable and retractable to move said workhead longitudinally with respect to said superstructure.

31. The vehicle of claim 30 comprising at least two of said workheads and at least two of said actuating means, each of said actuating means being uniquely associated with and controlling movement of one of said workheads.

32. The vehicle of claim 31 wherein said blowing tubes each define an exit opening, said workheads arranged in corresponding pairs, said corresponding workheads being spaced apart and aligned in a longitudinal direction, said exit openings of said blowing tubes of said corresponding workheads opening toward one another.

33. The vehicle of claim 32 wherein said actuating means includes a means for sensing said lateral disposition of said workhead.

34. The vehicle of claim 33 further comprising a means for positioning said blowing tube at a uniform height despite pivoting movement of said workhead, said means for positioning including means for adjusting a height of said workhead to compensate for said lateral disposition.

35. The vehicle of claim 34 wherein said workhead includes a vertical cylinder, said blowing tube mounted to said vertical cylinder, and wherein said means for adjusting a height includes a vertical cylinder control means for extending and retracting said vertical cylinder.

36. The vehicle of claim 35 wherein said workhead includes a workhead sleeve having an upper end and a lower end, said upper end of said workhead sleeve pivotally mounted to said first portion of said superstructure, said vertical cylinder pivotally mounted within said workhead sleeve and protruding from said lower end of said workhead sleeve, said workhead including a bias means for biasing said vertical cylinder in a home position with respect to said workhead sleeve, said workhead further comprising a sensor means for sensing relative movement of said vertical cylinder with respect to said sleeve.

37. A track maintenance vehicle comprising:

a superstructure adapted to ride on rails;

a vertically elongated workhead mounted on said superstructure, said workhead being pivotally attached to said superstructure, said vertically elongated workhead including a blowing tube having an adjustable length; and an automated height control means for automatically positioning said blowing tube at a uniform height in relation to said superstructure, said height control means adjusting said length of said workhead as a function of pivotal movement of said workhead.

38. The track maintenance vehicle of claim 37 comprising an actuating means for controlling pivotal movement of said workhead, said actuating means carried by said superstructure and operable to cause pivotal movement of said workhead with respect to said superstructure.

39. The track maintenance vehicle of claim 38 wherein said actuating means includes a lateral adjustment means for controlling a later al position of said workhead, said lateral adjustment means including a lateral cylinder extending between said superstructure and said workhead, said lateral cylinder being extendable and retractable to pivot said workhead in relation to said superstructure.

40. The track maintenance vehicle of claim 38 wherein said actuating means includes a longitudinal adjustment means for controlling a longitudinal position of said workhead, said longitudinal adjustment means including a longitudinal cylinder extending between said superstructure and said workhead, said longitudinal cylinder being extendable and retractable to pivot said workhead in relation to said superstructure.

41. The track maintenance vehicle of claim 37 wherein said automated height control means includes a means for sensing said lateral disposition of said workhead.

42. The track maintenance vehicle of claim 37 wherein said workhead includes only a single blowing tube.

43. The track maintenance vehicle of claim 1 wherein said workhead terminates in only a single blowing tube.

44. The track maintenance vehicle of claim 37 wherein said superstructure has a maximum height above the rails, said superstructure further having a pivot location disposed at a height above the rails that is greater than about 75% of said maximum height, said workhead being attached to said pivot location.

* * * * *